US009527666B1

(12) United States Patent
Patton

(10) Patent No.: US 9,527,666 B1
(45) Date of Patent: Dec. 27, 2016

(54) HAND-HELD TRASH BAG TOOL

(71) Applicant: Gary Van Patton, Alto, NM (US)

(72) Inventor: Gary Van Patton, Alto, NM (US)

( * ) Notice: Subject to any disclaimer, the term of this patent is extended or adjusted under 35 U.S.C. 154(b) by 0 days.

(21) Appl. No.: 14/660,599

(22) Filed: Mar. 17, 2015

Related U.S. Application Data

(60) Provisional application No. 61/977,164, filed on Apr. 9, 2014.

(51) Int. Cl.
*B65B 67/04* (2006.01)
*B65F 1/14* (2006.01)

(52) U.S. Cl.
CPC ..... *B65F 1/1415* (2013.01); *B65F 2210/18* (2013.01)

(58) Field of Classification Search
USPC ... 248/95, 97, 99, 100, 101; 294/1.4, 28, 30, 294/31.1
See application file for complete search history.

(56) References Cited

U.S. PATENT DOCUMENTS 4,702,445 A 10/1987 Ivory
4,940,201 A * 7/1990 Kurth ..... B65B 67/12 248/101
5,033,703 A 7/1991 Allen, Sr.
5,217,271 A 6/1993 Moe
5,377,941 A 1/1995 Har
5,380,054 A 1/1995 Galvis
5,588,622 A * 12/1996 Gordon, Sr. ..... B65B 67/1238 24/30.5 R
6,003,820 A 12/1999 Baldonado
6,068,311 A 5/2000 Jones
6,257,634 B1 * 7/2001 Wei ..... E01H 1/12 294/111
6,431,503 B1 * 8/2002 Horan ..... B65B 67/1255 248/101
6,508,496 B1 * 1/2003 Huang ..... E01H 1/12 294/115
7,618,073 B2 11/2009 Casper
7,744,136 B2 6/2010 Waltz
9,067,700 B1 * 6/2015 Middleton ..... B65B 67/1233
2003/0019981 A1 * 1/2003 Stanfield ..... B65B 67/1233 248/101
2012/0091174 A1 4/2012 Breeze

* cited by examiner

*Primary Examiner* — Steven Marsh
(74) *Attorney, Agent, or Firm* — Stephen D. Carver

(57) ABSTRACT

A portable tool transports and manipulates disposable trash bags with a pair of cooperating, displaceable jaws coupled to a rigid, peripheral frame. The substantially circular frame conceals the jaws when retracted within suitable peripheral grooves in which the jaws nest. A manual activator compressively attached to the frame midsection supports a pistol-grip handle and associated trigger mechanism. Each jaw has a pivoted hub portion with integral, projecting levers concealed within a clutch mechanism. A trigger deflects a cable to pivot the hub levers and deploy the jaws. When the jaws are displaced outwardly, upper edges of a bag may occupy the space between the jaws and the frame. When the trigger is released, the jaws retract in response to spring pressure, nesting within the frame peripheral grooves. The jaws thus securely grasp and captivate a bag, the upper periphery of which is sandwiched between the frame and the seated jaws.

20 Claims, 19 Drawing Sheets

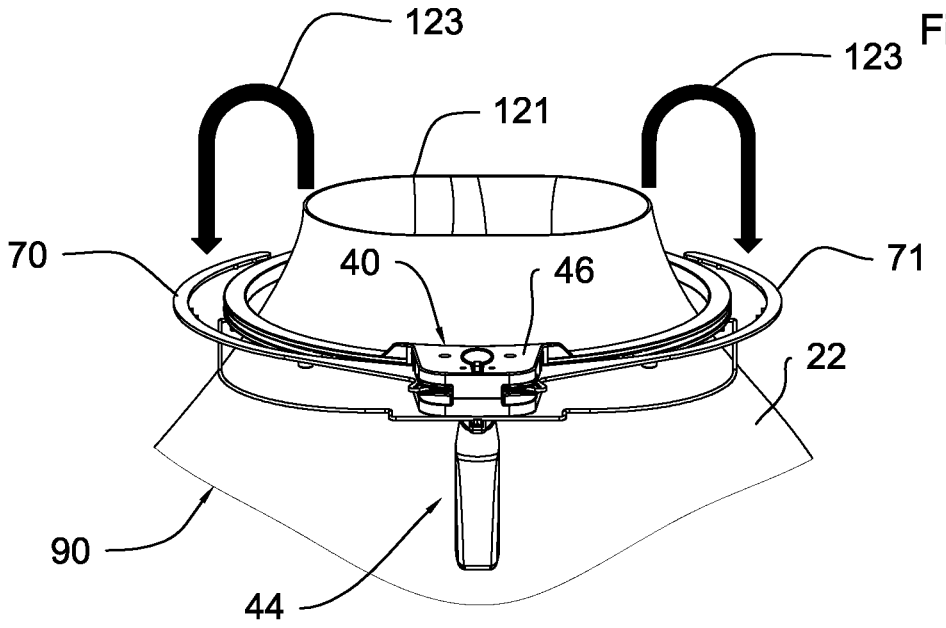
Fig. 14
Fig. 15
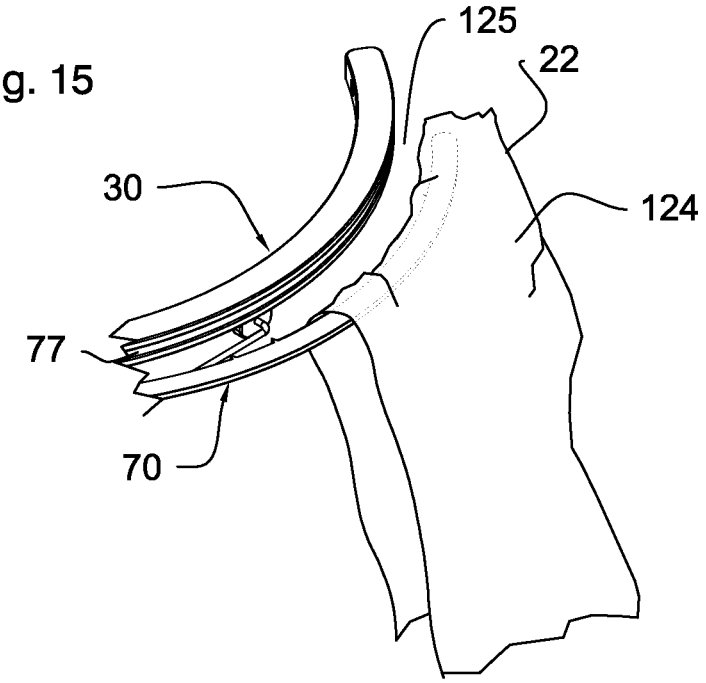

HAND-HELD TRASH BAG TOOL

CROSS-REFERENCE TO RELATED APPLICATION

This utility patent application is based upon, and claims priority from a prior U. S. Provisional patent application entitled "Hand-Held Trash Bag Tool," Ser. No. 61/977,164, filed Apr. 9, 2014, by sole inventor Gary Van Patton.

BACKGROUND OF THE INVENTION

I. Field of the Invention

The present invention relates generally to apparatus for handling trash bags, garbage bags and the like. More particularly, the present invention relates to hand tools with pistol-grip-activated jaws for grasping, manipulating and transporting bags of trash or garbage. Known prior art pertaining to the invention may be found in United States Patent Class 294, Subclasses 29, 30 and 31.1 and elsewhere.

II. Description of the Prior Art

Garbage and trash accumulate constantly in households. Numerous prior art structures have been designed for handling various types of flexible, disposable bags made of materials such as paper, fabric and/or plastic. Typical bags include garbage bags of various capacities, lawn and garden bags, various sizes of wastebasket bags or liners, and the like. Such flexible bags are often difficult to retain in an open position for convenient loading, especially where spilling is to be avoided. When armfuls of leaves, cut grass, weeds and the like are to be loaded within the bags for subsequent disposal, ease of filling becomes a major design imperative. Of course the minimization of spillage is a persistent goal.

Thus the prior art reflects a number of portable, hand-operated tools that can be used to store, manipulate and/or transport garbage bags, trash bags and similar items. Sometimes structure capable of manipulating diverse bags is capable of additional diverse functions. There are many city and municipal laws or ordinances requiring the cleanup of animal waste from parkways, trails, walkways and the like. Similar requirements are effective at hotels and motels, and they are promulgated in leases and condominium agreements. Of course it is desirable to employ sanitary pick-up means or devices for cleaning up the droppings from dogs, cats, horses, and other animals. Ideal devices should enable the control, loading, transportation and disposal of the bags or containers used to captivate the refuse in a sanitary manner that is as safe, clean, and as fast as practicable. It is particularly desirable to accomplish rapid cleanup in a sanitary manner without contaminating or soiling the user's hands or clothing.

The typical non-commercial, plastic garbage bag utilized by most consumers may be packaged and sold in a roll. After a user unrolls an individual bag, it must be subsequently grasped and manipulated with ones fingers to properly open the bag. The abutting plastic sides must be dislodged from one another, and this can be difficult, as the bags are tightly stored in a compressed form in the roll with bag sides, which are sometimes sticky, forcibly abutting one another. Opening the bag by unfolding or unwrapping the bag sides from their previous side-by-side, compressive disposition is often difficult and time consuming, if not annoying. Furthermore, it is difficult to maintain the bag in an open position, once it is finally unwrapped and unfolded and then deployed. Even after unwrapping and deployment, it is difficult to maintain and hold garbage bags in an accessible, user friendly orientation. Unfilled bags tend to sag and droop. Full and partially filled bags tend not only to droop, but to spill their contents as well.

Thus, there are numerous prior art devices for holding disposable garbage bags in an upright, open position.

For example, U.S. Pat. No. 4,702,445 issued Oct. 27, 1987 depicts a bag support device for expanding and holding garbage bags. The bag support device comprises a pair of interlocking support rings engageable with the disposable bag.

U.S. Pat. No. 5,217,271 issued Jun. 8, 1993 illustrates a portable bag holder that may be used to support a single garbage bag or a pair of garbage bags. The bag holder can support a pair of garbage bags when trash is segregated into recyclable and non-recyclable items. A pair of bungee cords are attached to the holder to secure the bags.

U.S. Pat. No. 5,033,703 issued Jul. 23, 1991 shows a garbage bag holder comprising numerous ring assemblies that maintain captivated bags in a vertically stabilized, open configuration. The ring assemblies include primary rings which are cantilevered from racks having offset supports, and secondary rings that lock bags to the primary rings.

U.S. Pat. No. 5,377,941 issued Jan. 3, 1995 shows a support for holding a disposable waste bag in a kitchen sink. The device comprises an open frame through which the waste bag may be inserted with the bottom of the bag supported upon the floor of the sink. The top portion of the bag is folded over the frame with provisions for clamping the folded-over portion to retain the bag. The support frame or a hinge for the frame is affixed by suction cups, glue or the like, to the sink.

U.S. Pat. No. 6,068,311 issued May 30, 2000 discloses a portable pickup and transporting device for animal droppings and the like that permits the user to collect material in a disposable bag supported on device for ready removal and replacement by a fresh bag. The pickup device includes an elongated body having a handle at one end and a pickup arrangement at its other end. The pickup arrangement includes a stationary bail fixed to a yoke carried on the body and a movable bail carried on the yoke. An actuating mechanism carried on the body includes an elongated rod having a lever mechanism adjacent to the handle and an offset connection for actuating the movable bail.

U.S. Pat. No. 7,744,136 issued Jun. 29, 2010 discloses a collection and bagging device for collecting and disposing of refuse or fecal matter at a distance from a user. The device comprises a handle with an actuating trigger. A foldable extension shaft terminates in a set of claws actuated by a cable extending to the trigger. The claws, which are spring biased towards a normally open position, have teeth that intermesh with each other when in a closed position to get beneath the refuse or material being collected. Once refuse is collected, the device can be raised to a horizontal position, thereby causing the collected material to fall into the attached bag for easy disposal.

U.S. Pat. No. 7,618,073 issued Nov. 17, 2009 discloses a portable, hand-operated tool for collecting waste in a bag, comprising an elongated shaft member, a ring member, and two clamps. The tool provides for the securing of a bag on the ring member such that no part of the ring member or the outside surface of the bag may come in contact with the waste to be collected. The tool utilizes an arcuate ring member and there is substantially no angle between the ring member and the elongated shaft member.

U. S. Pat. No. Application No. 20120091174 published Apr. 19, 2012 shows a hand-held trash bag holder that may be easily carried. The holder comprises a rigid frame and a plurality of clips that attach to, and hold open, a garbage bag. The support frame has a forearm support that extends from it, which the user secures to his or her forearm, along with a gripping handle that the user holds in his or her hand. The device keeps the bag open for easy trash placement. The device may also be attached to a user's belt with a clip for transport when not in use.

Notwithstanding the foregoing prior art attempts at providing garbage bag manipulators, the are does not reflect a pistol-grip system for controlling a typical plastic garbage bag

SUMMARY OF THE INVENTION

This invention provides a portable, pistol grip-activated hand tool for handling and engaging trash or garbage bags, and a convenient stand to which the tool is fitted for placing gripped bags that are full of trash.

The portable tool handles and manipulates typical disposable trash bags. The rigid, substantially circular frame mounts a pair of displaceable jaws that can be displaced by a trigger assembly. Normally the jaws are seated within peripheral grooves in the outer periphery of the frame. When the jaws are displaced outwardly, upper edges of a garbage bag may occupy the space between the jaws and the frame. When the trigger mechanism is released, the jaws retract in response to spring pressure, nesting within the frame peripheral grooves. The jaws thus securely grasp and captivate a bag, the upper periphery of which is sandwiched between the jaws and frame.

The frame has a midsection to which an activator is compressively attached. A pistol grip handle projects downwardly from the activator, being spaced apart from a trigger mechanism. A trigger operated clutch mechanism deflect a cable connected to levers on hub portions of the jaws. The jaws are displaced by deflecting the cable to pivot the hubs. When the trigger is released, the jaws retract in response to spring pressure, and are seated within the frame grooves.

Thus a basic object is to provide a portable, hand operable trash and garbage bag system including a manipulation and carrying tool, and a cooperating storage stand or tool.

A similar basic object is to provide a hand tool for conveniently manipulating and transporting garbage and trash.

A related object is to provide a hand-tool for handling trash and a cooperating stand that mates with the tool and provides a temporary support.

Another important object is to provide a tool of the character described that provides a sanitary pickup device for garbage and trash bags and the like.

A related object is to provide a garbage bag handling tool that can be employed with medical waste bags, bio-hazard bag containers and the like.

Another object of the invention to provide an improved bag tool which may be used for the collection of garbage and trash, and to provide a storage rack for the tool and bag captivated thereby.

Another object is to provide a tool of the character described aids in the collection and disposal of lawn and yard waste, including grass cuttings, pine cones and pine needles, and dead leaves.

A further object is to provide a tool of the character described that provides a convenient sanitary pickup and transporting device for waste materials such as animal feces, droppings or the like, and which permits the user to collect the material in a disposable bag means supported on the pickup device for ready removal and replacement by a fresh An object of the invention is to provide a one handed means for getting underneath refuse and fecal matter on the ground in order to contain the matter for removal and disposal without smashing the refuse or fecal matter in the jaws of the collection device.

Another object of this invention is to provide a one handed means for bagging the refuse and fecal matter using commonly available plastic shopping bags.

Yet a further object of this invention is to provide a means for collapsing the collection means when not in use for convenient storage or transportation.

Still another object of the invention is to provide an improved bag holder which permits the installation of a single garbage bag thereon or which permits the installation of two or more garbage bags thereon to permit the segregation of trash from recyclable items. It is an object of the present invention to provide a device or tool for collecting waste that will minimize the possibility of a person coming into contact with waste that is being collected.

It is another object of the present invention to provide device that is simple in construction and easy and convenient to use.

It is yet a further object of the present invention to provide a device that allows a person to make multiple waste collections using a single bag without having to re-situate the bag after each collection.

It is therefore an object of the present invention to provide a new and improved utility hopper that has all of the advantages of the prior art and none of the disadvantages.

Another object of the present invention is to provide a device of the character described that aids in the collection, harvesting, carrying, transportation and manipulation of bagged garbage.

A still further object of the invention is to provide a portable bag holder which accommodates persons of different heights.

Still another object of the invention is provide a portable bag holder which maintains the ends of the bag or bags in an open position to facilitate the placement of trash or other materials therein.

Yet another object of the invention is provide a bag holder which prevents trash from blowing from or flowing out of the bag when the bag is in use or placed on the ground.

Yet another object of the invention is to provide a safe and easy means for removing items impaled on a nail stick.

Another object is to provide a bag holder of the character described which is easy to use and carry. It is a feature of the invention that a folding handle makes the device easier to carry. Another feature is that a trigger locks the jaws open to make it easier to install or grasp a trash bag.

Still another object of the invention is to provide a portable bag holder which maintains the bag or bags in an open position so as to speed the collection process.

Still another object of the invention is to provide a portable bag holder which is economical of manufacture, durable in use and refined in appearance.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 14 is a fragmentary, diagrammatic view showing the tool with the jaws deflected and opened to engage edges of a trash bag to be captivated;

FIG. 15 is a fragmentary, diagrammatic view showing the tool captivating a trash bag, with the jaws still open just prior to release;

DETAILED DESCRIPTION

Figure 13:
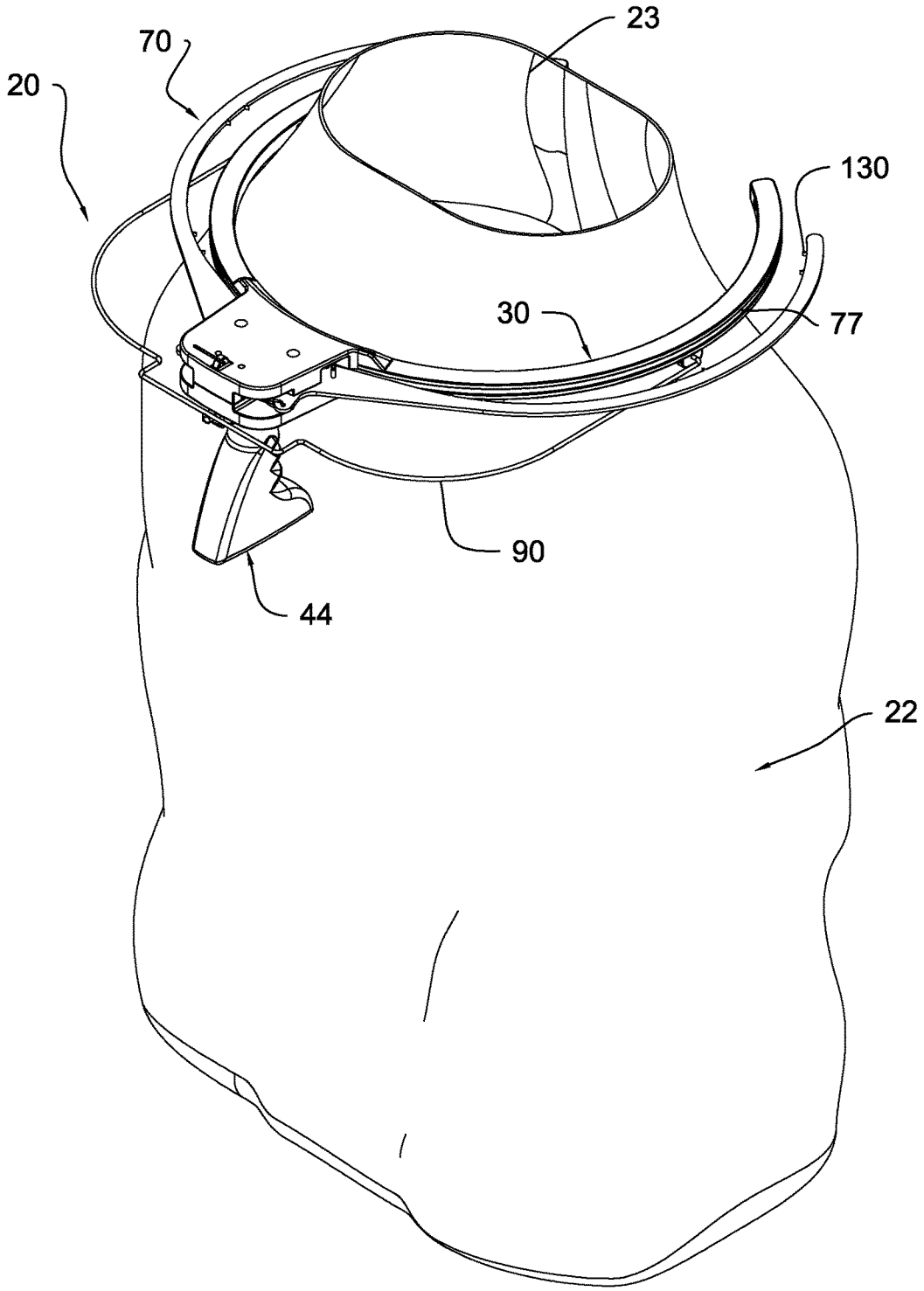
FIG. 13 is a fragmentary, diagrammatic view showing the tool positioned over a trash bag to be engaged.

With initial reference directed now to FIGS. 1-4 of the appended drawings, a hand-held trash bag tool, illustrated in accordance with the best mode of the invention known to me at this time, has been generally designated by the reference numeral 20. While there are a variety of applications for which tool 20 is useful, its primary design function is to manipulate and control flexible, plastic trash bags of the disposable type. A typical disposable trash bag has been designated by the reference numeral 22 in FIGS. 13-15, which are described in detail hereinafter. It should be appreciated at the onset that the terms "bag" or "bags," or "trash bag" or trash bags," as used herein, refer to a variety of conventional and common garbage bags, trash bags, and waste bags of various sizes, whether disposable or not, which are made of different, at least somewhat flexible materials such as fabric, paper, plastic, or combinations thereof. Tool 20 is a portable device that enables users to securely grasp and captivate a bag about its upper periphery, and to transport the bag and stow it upon a suitable support, such as the optional stand 24 described hereinafter (i.e., FIGS. 18, 19). Importantly, the bag 22 remains in the open or "fill" position while it is captivated by the tool 20, and, providing the tool is properly stowed, the bag 22 will not droop or sag or spill. A bag upper periphery, generally designated by the reference numeral 23 (FIG. 13), is first positioned within the frame 30, and then folded over the frame between the jaws described below and the frame periphery, whereupon release of the jaws captures the bag.

Figure 5:
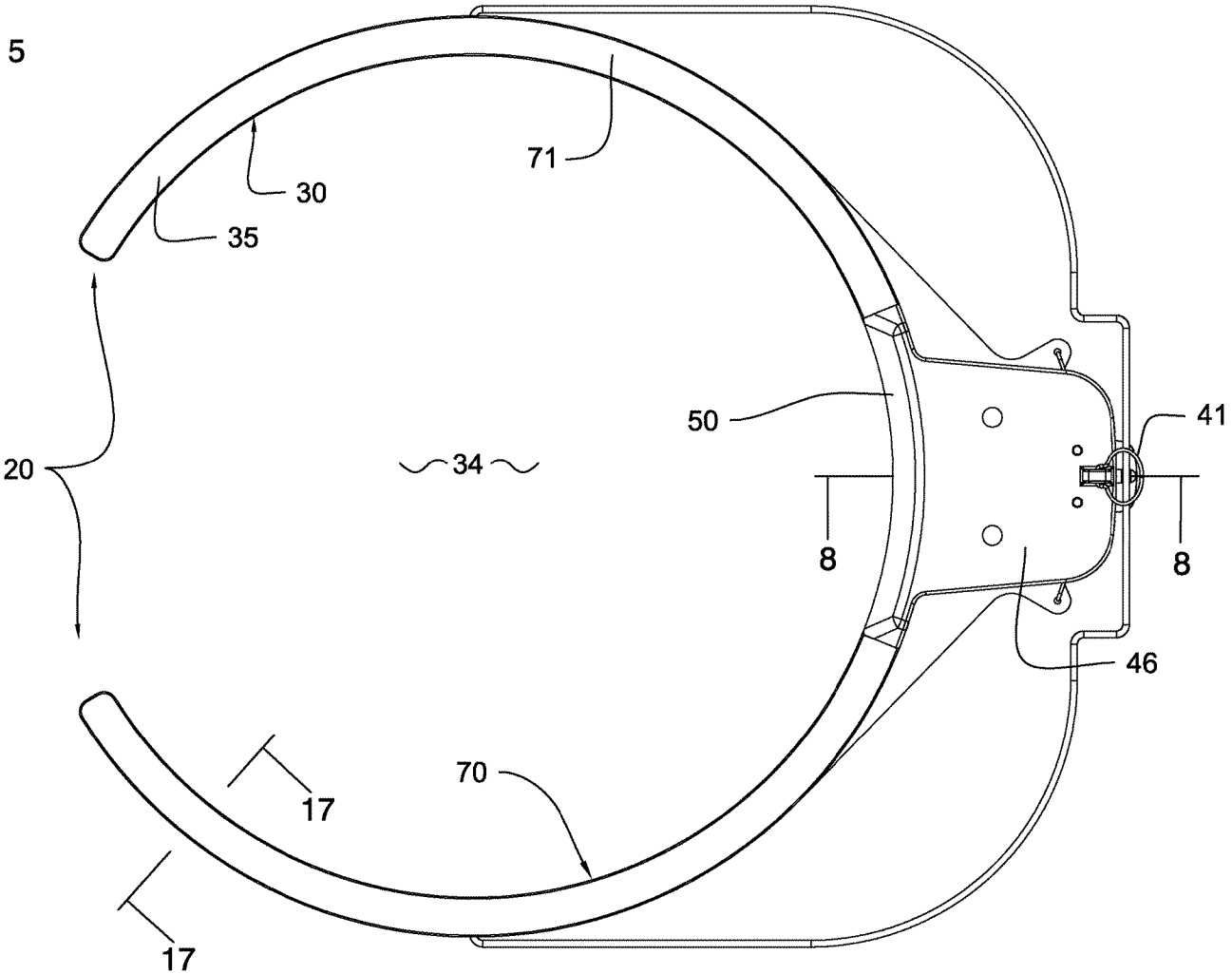
FIG. 5 is an enlarged top plan view of the tool.
Figure 6:
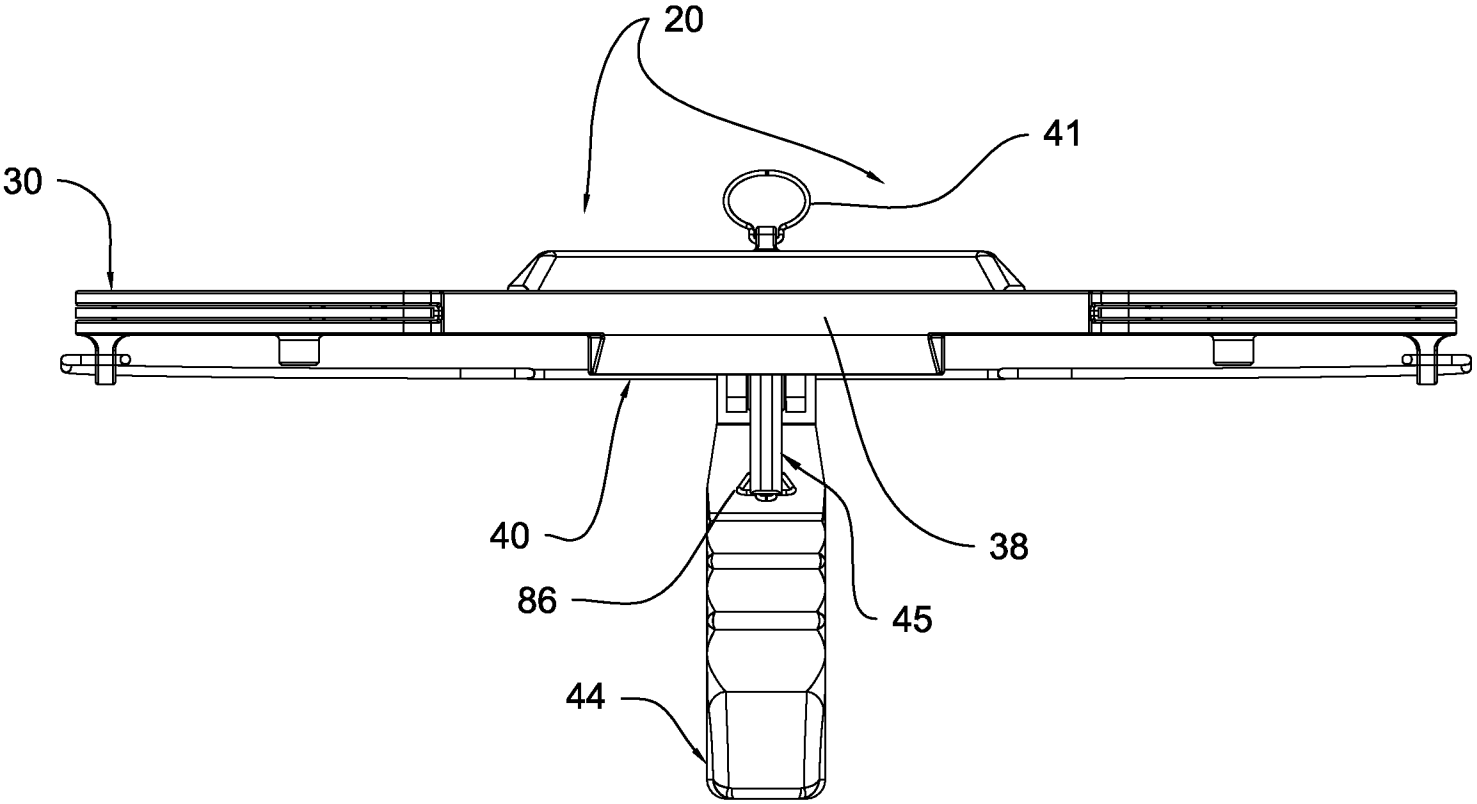
FIG. 6 is an enlarged front plan view of the tool.

Tool 20 comprises a substantially rigid, hoop-like frame 30 that is preferably generally circular. However, frame 30 has an open or unobstructed end 33, so that the frame is shaped somewhat like a horseshoe or the letter "C". While the shape of the frame 30 may vary, the frame 30 will substantially encircle a region 34 (i.e., FIGS. 5, 7, 9) that will be substantially occupied by a trash bag when captivated by the tool 20. Preferably the diameter of the frame 30 is approximately equal to the diameter of a trash bag that is to be suspended by and/or captivated by tool 20.

In vertical cross section (i.e., FIG. 17) the frame 30 has a generally square cross section. There is an exposed, upper external frame surface 35 (FIG. 1) that is parallel and coextensive with an exposed, lower external surface 36 (FIG. 2). Frame 30 has an internal midsection 38 that is compressively engaged by an activator 40, to which a pistol grip handle 44 is operatively attached. Handle 44 may be grasped manually for controlling, manipulating and aiming the tool 20. Activator 40 comprises an upper, removable clamping plate 46 and a rigid, lower base plate 48 (i.e., FIGS. 7, 8) to which pistol-grip handle 44 is attached. The upper, removable clamping plate 46 has an integral, arcuate clasp portion 50 projecting from its generally planar body 51 (i.e., FIGS. 1, 7). The lower junction base plate 48 (i.e., FIGS. 2, 3) comprises a similar, integral arcuate clasp portion 54 (i.e., FIGS. 2, 10) that is generally coextensive with clasp portion 50. The frame 30 is supported between and captivated by the opposed clasps 50, and 54 which compressively sandwich and captivate frame midsection 38 upon assembly, to join activator 40 to the frame 30. The body 51 (FIG. 7) of activator 40 preferably comprises a carrying ring 41 to aid in transporting tool 20.

Figure 11:
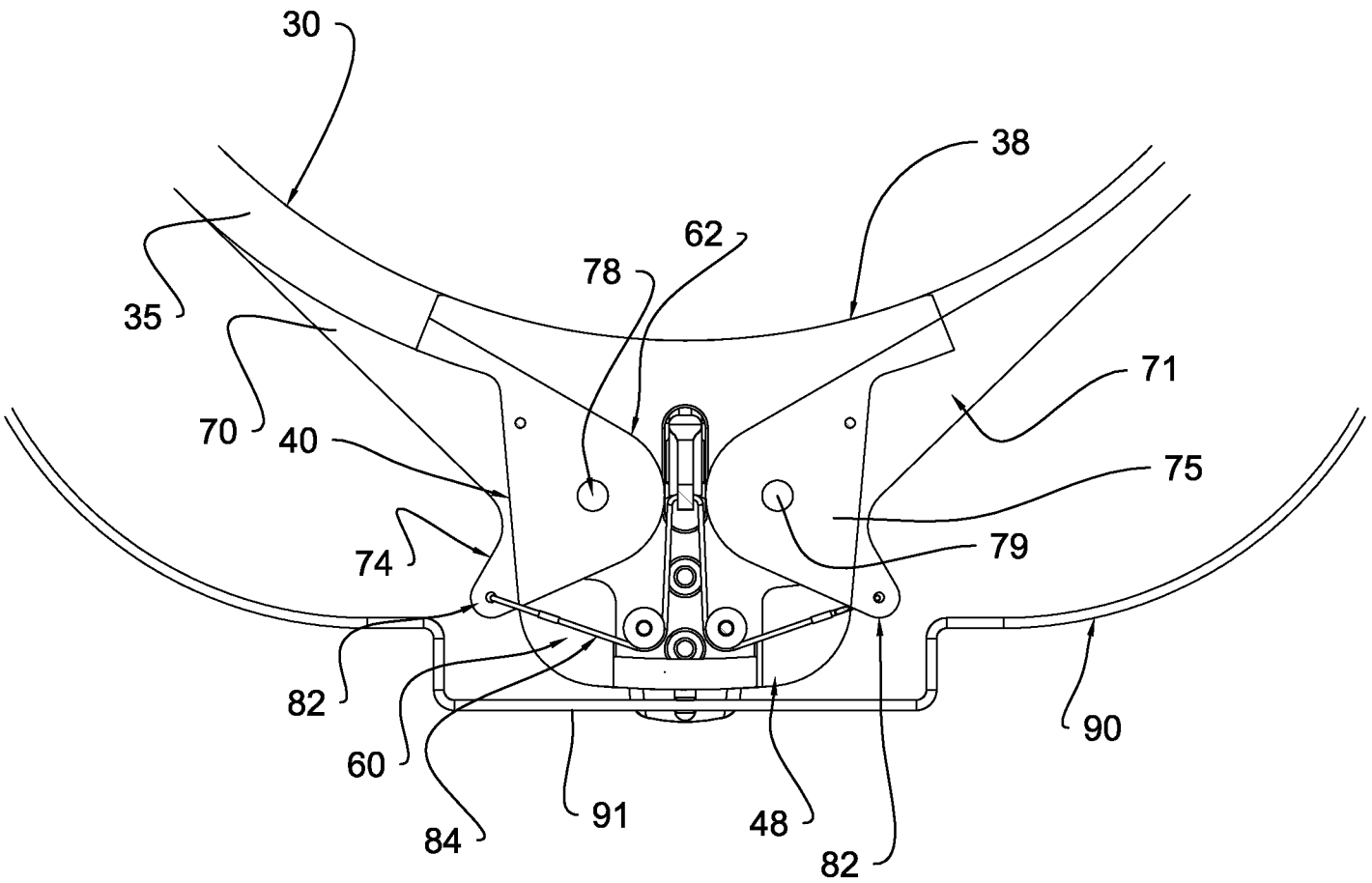
FIG. 11 is an enlarged, fragmentary sectional view of the tool taken generally along line 11-11 in FIG. 8, showing the tool and trigger mechanism in a relaxed state grasping a bag.

As described below, the lower activator base plate 48 has a rigid, flat portion 60 (FIG. 11) to which the handle 44 is threadably attached. The handle 44 operates a clutch mechanism, generally designated by the reference numeral 62 (FIG. 11), that is housed upon the flat portion 60 of lower junction base plate 48 and is shrouded by the upper junction clamping plate 46 (i.e., FIGS. 1, 7) upon assembly.

Figure 9:
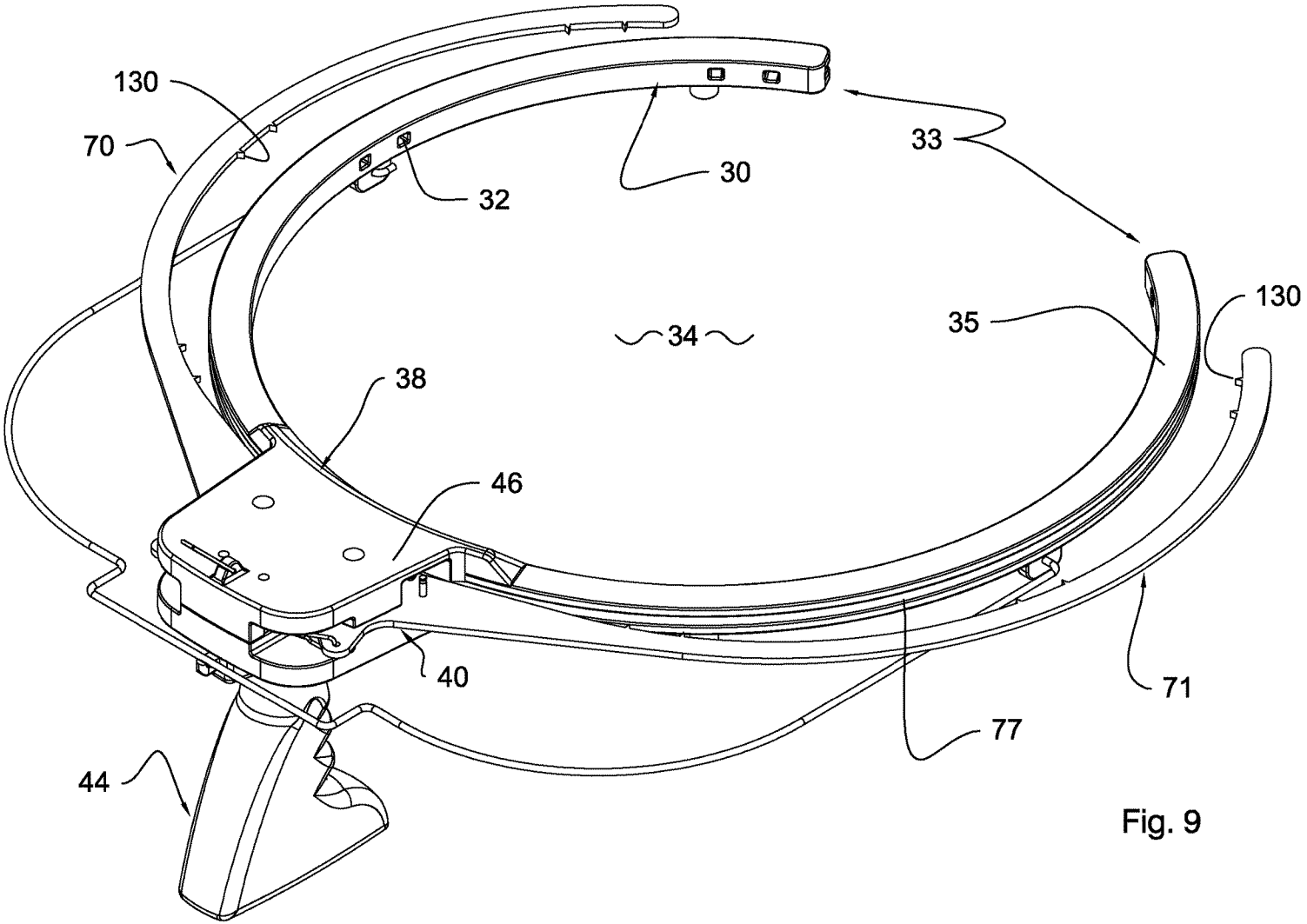
FIG. 9 is a rear isometric view of the tool deployed in a bag loading position, with the jaws deflected outwardly.
Figure 10:
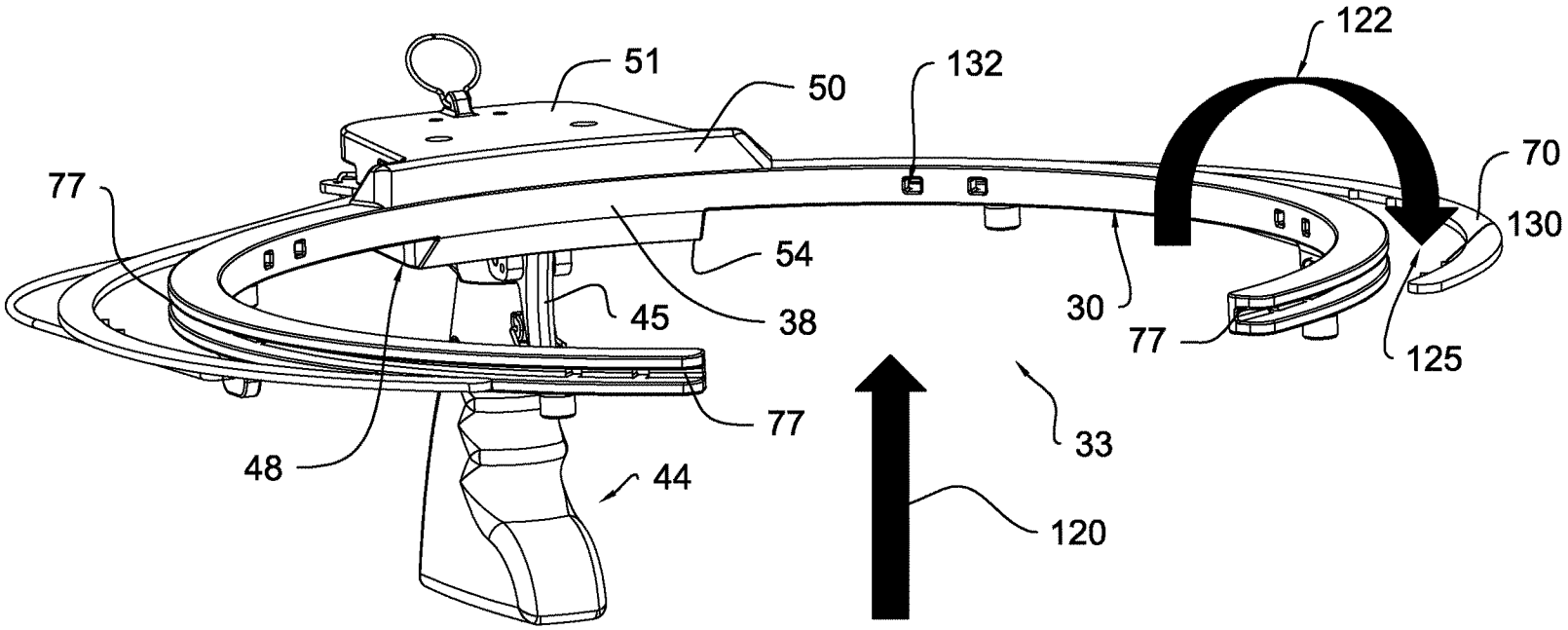
FIG. 10 is a combined frontal isometric and diagrammatic view of the tool shown in a loading position, with arrows indicating travel of a bag to be grasped.

As best viewed in FIGS. 9 and 10, the frame 30 supports a pair of cooperating, articulated jaws 70, 71 that are displaceable outwardly from the frame periphery. The jaws 70, 71 normally assume a retracted position substantially flushly abutting the frame periphery. The jaws may be made of rigid metal, or resilient plastic. When the jaws are retracted or at rest a garbage bag can be captivated; when the jaws 70, 71 are triggered and displaced, a garbage bag can be released. Preferably the arcuate jaws 70, 71 are shaped similarly to the frame 30 for at least a portion of their length, so that, when in the est position, they can flushly abut the frame 30 and/or nest within it. The preferably complementary jaws 70, 71 are displaced outwardly in response to activation by the trigger assembly 45 (FIG. 2) that is attached to plate 48 and spaced apart from pistol grip 44

Figure 3:
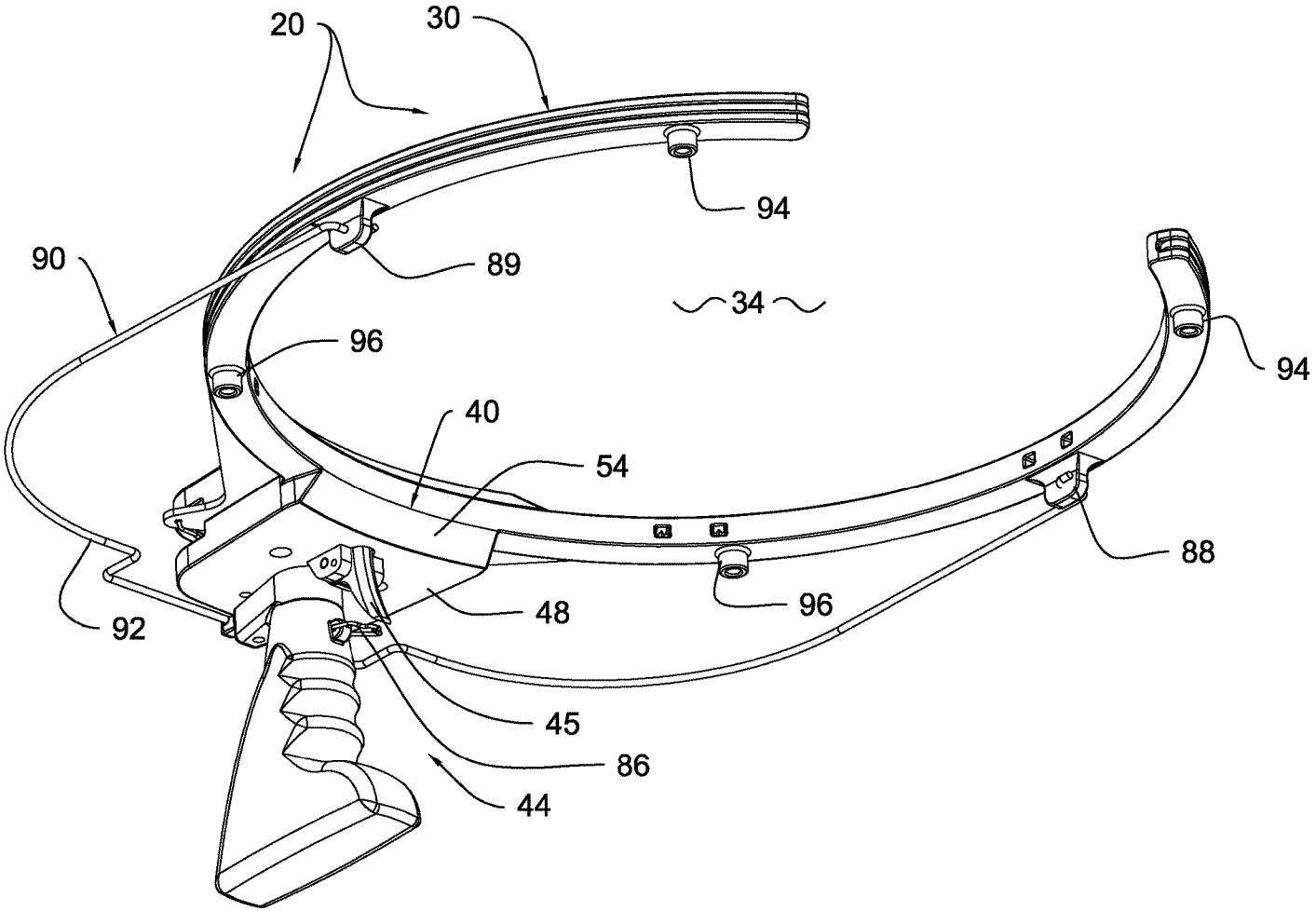
FIG. 3 is a bottom isometric view of the tool similar to FIG. 2, but taken from an opposite side.
Figure 4:
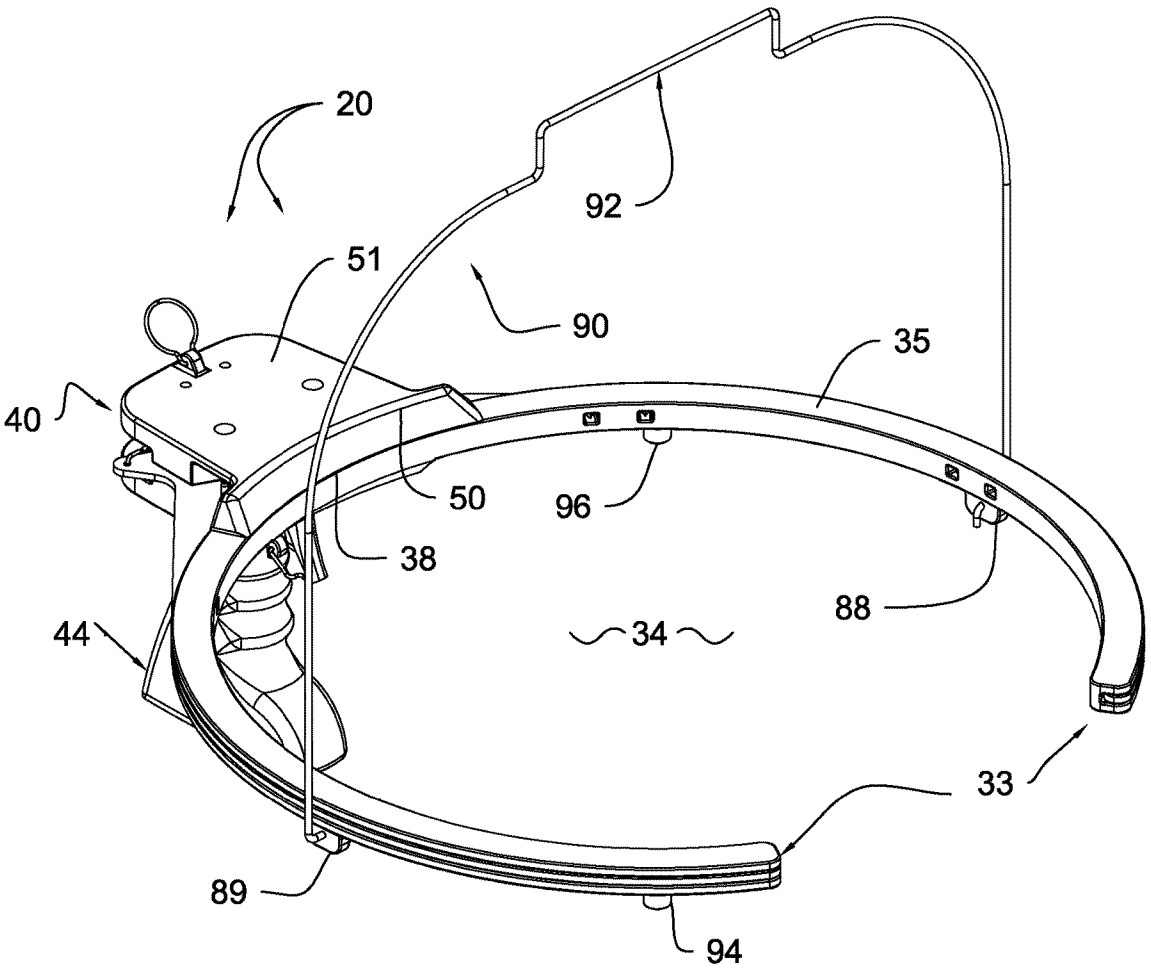
FIG. 4 is a frontal isometric view of the tool showing the carrying handle deployed.

(FIG. 3). The jaws are shown displaced in FIGS. 9 and 10 and elsewhere. The jaws are at illustrated at rest or refracted in FIGS. 1, 4 and 5 and elsewhere.

Jaws 70, 71 are each arcuate, and substantially flat. Preferably the jaws 70, 71 nest within grooves 77 (FIGS. 9, 10) defined in the outer periphery of the frame 30 when in the retracted state or rest position. Thus the jaws are preferably shaped to retractably fit within grooves 77, where they can nest with portions of a trash bag captivated between them and the frame 30. Jaws 70 and 71 are activated by clutch mechanism 62 described below (FIGS. 11, 12), that is in turn activated by trigger assembly 45 while a user grasps pistol grip handle 44.

Figure 7:
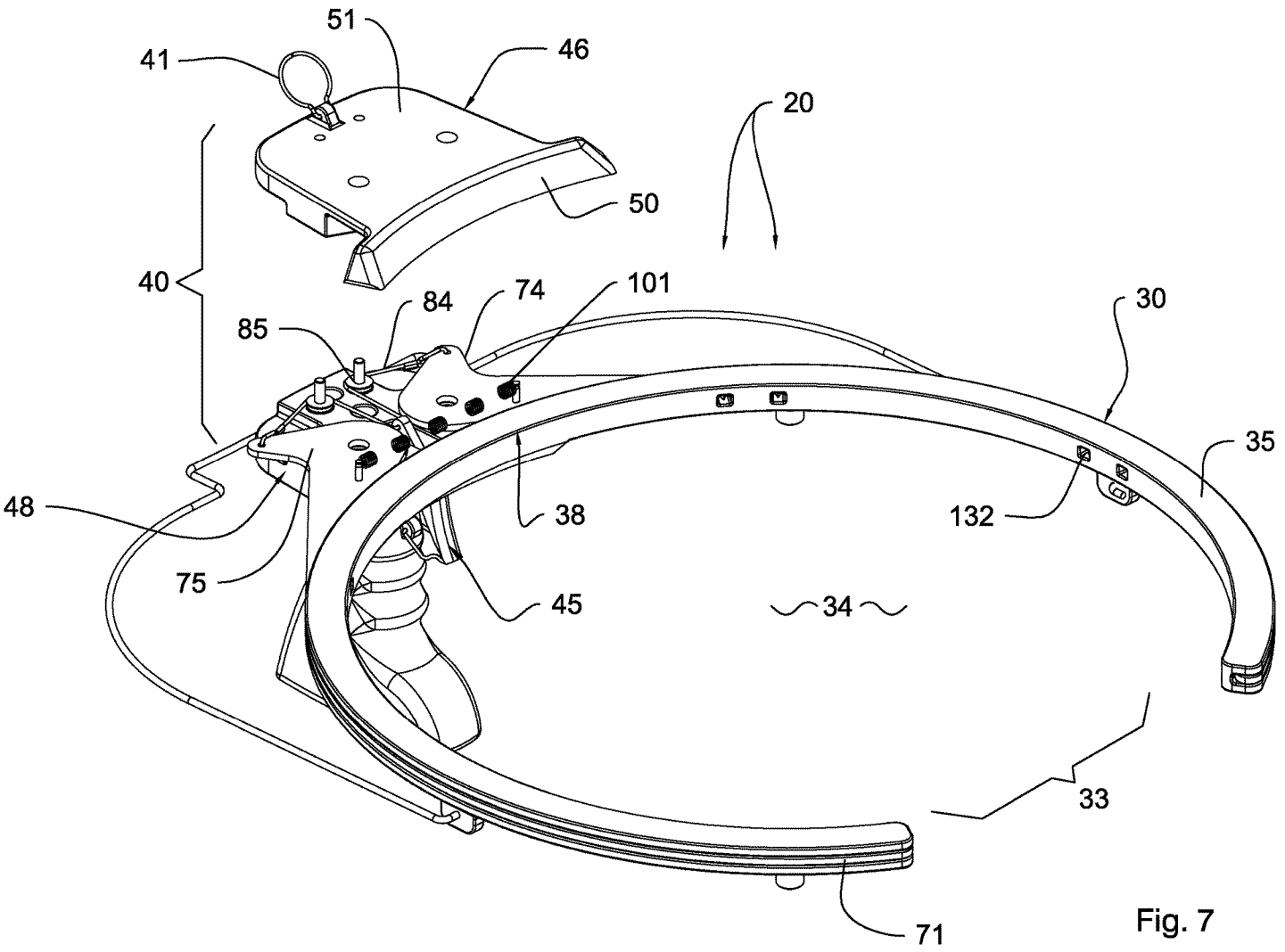
FIG. 7 is a partially exploded, fragmentary isometric view of the tool.
Figure 8:
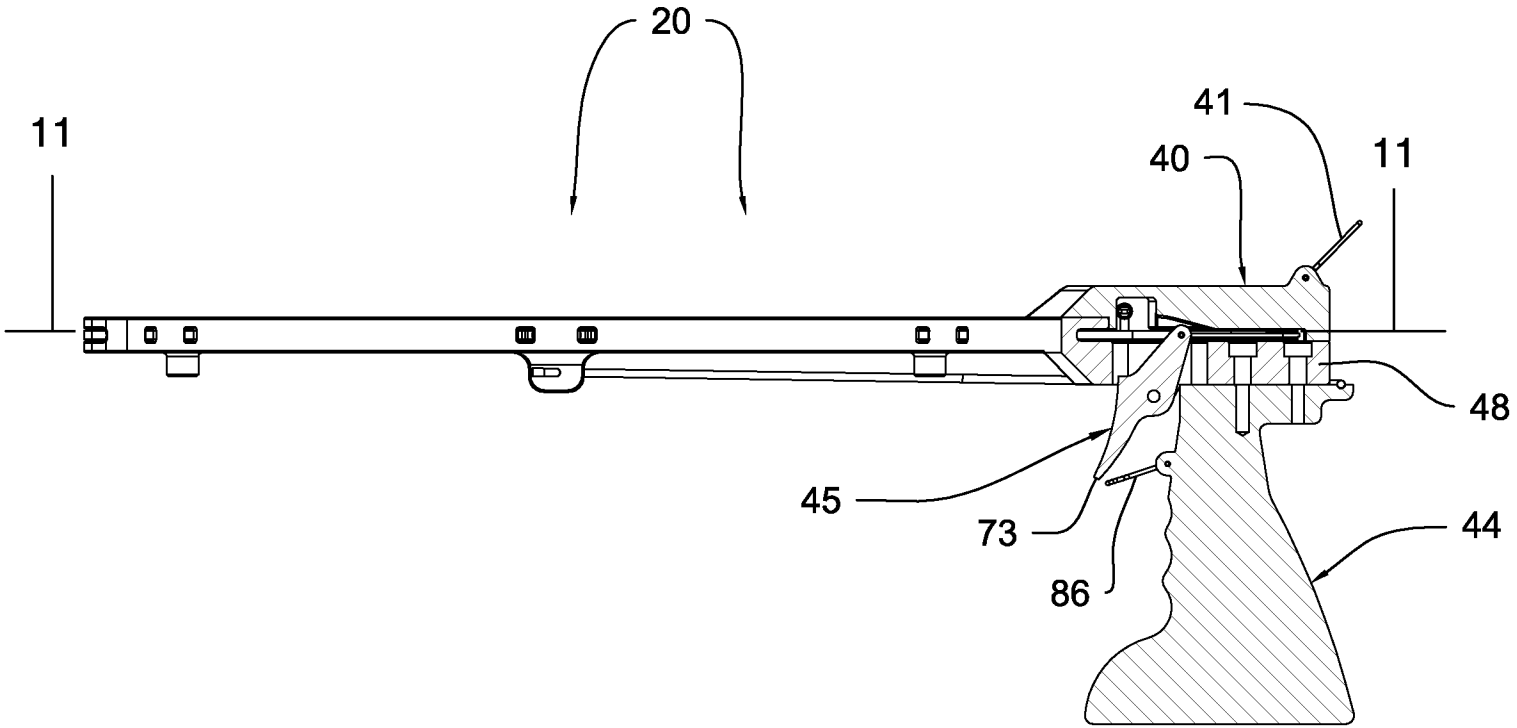
FIG. 8 is an enlarged, fragmentary sectional view taken generally along line 8-8 in FIG. 5.
Figure 12:
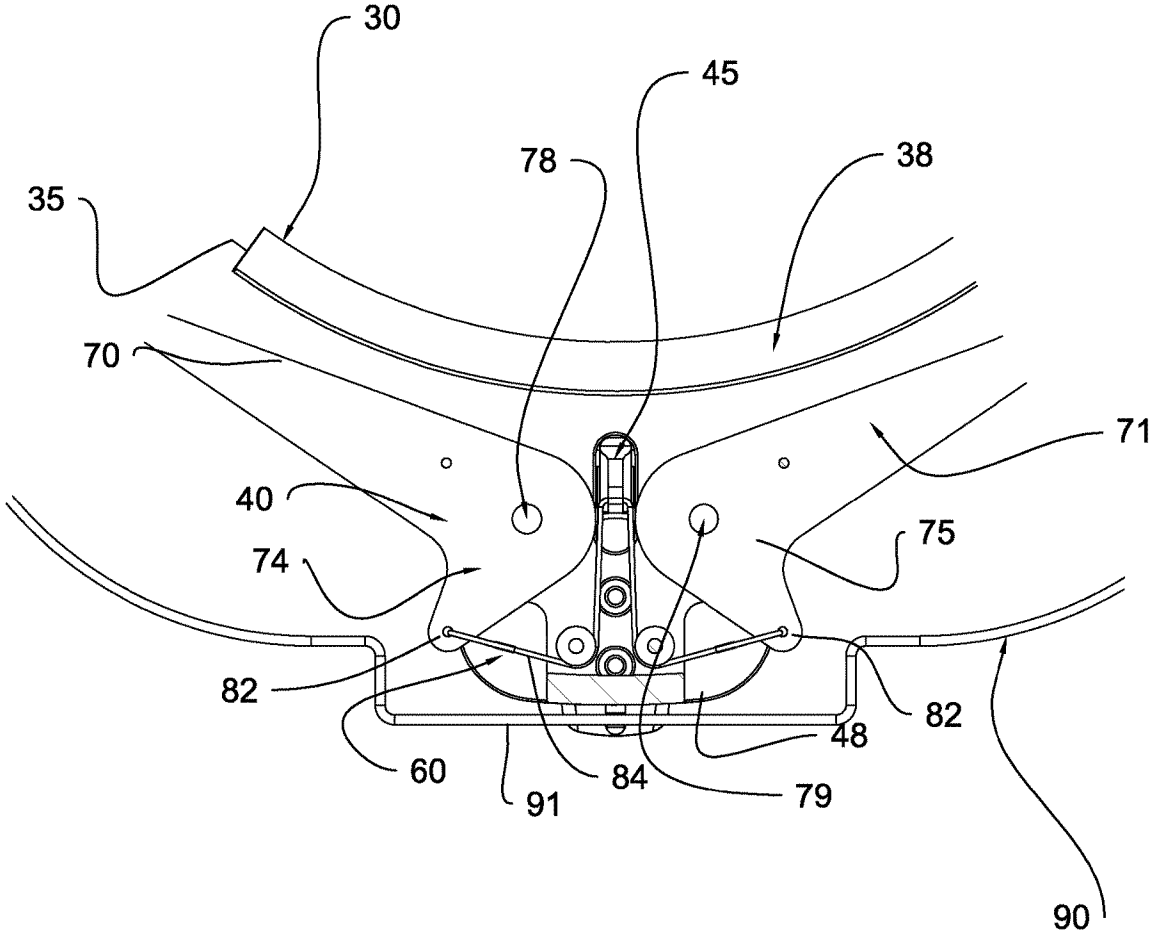
FIG. 12 is a fragmentary sectional view of the tool similar to FIG. 11, but showing the trigger mechanism as it appears with the jaws deflected outwardly as occurs just prior to grasping a bag, or when releasing a bag.

Noting FIGS. 7 and 12, jaws 70, 71 comprise integral, pivoting hubs 74, 75 that are pivoted by suitable fasteners (not shown) inserted within orifices 78, 79 (FIG. 12) respectively within clutch mechanism 62. Each jaw hub 74, 75 comprises an outwardly, rearwardly projecting lever 82 portion that can be deflected by a cable 84 (FIG. 12) that is activated in response to manual deflection of trigger assembly 45.

Figure 16:
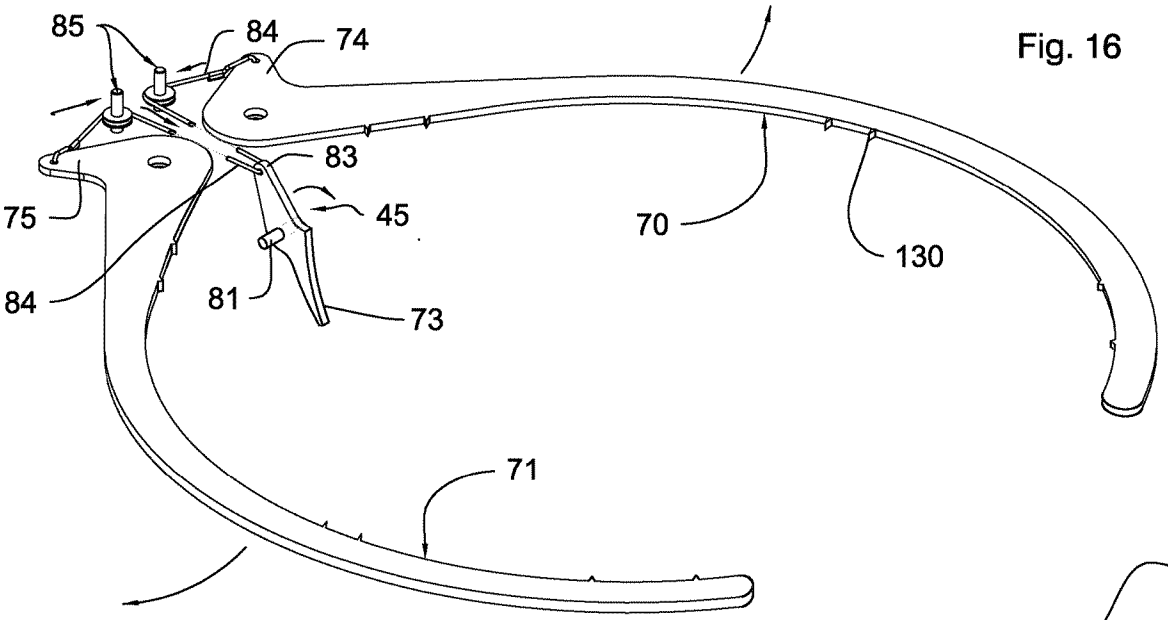
FIG. 16 is a fragmentary, diagrammatic isometric view of the preferred jaws and trigger mechanism, with portions thereof omitted for brevity.

Trigger assembly 45 (i.e., FIGS. 2, 7, 10) on the activator 40 has a lower finger-operated trigger 73 (FIG. 16) that is deflected by a user. The trigger assembly 45 is pivoted by shaft 81, so that upper trigger portion 83 (FIG. 16) is deflected by trigger pull. Upper trigger portion 83 is linked to cable 84 (FIG. 16) which in turn is linked to hubs 74, 75 (FIGS. 11, 12) at lever portions 82, being routed around idler pulleys 85 (FIGS. 12, 16). Thus when the trigger assembly 45 is activated by a user, trigger 83 pulls cable 84 towards the center of the frame 30, deflecting jaws 70, 71 about pivot orifices 78, 79 (FIGS. 11, 12) respectively. In this manner jaws 70, 71 are activated and displaced outwardly from frame 30 to assume the "open," bag-receptive position illustrated in FIGS. 13-15. At this time a trigger latch 86 (FIGS. 2, 8) may be deflected to engage and restrain the trigger 73 against pressure from cable 84 and a transverse spring 101 (FIG. 7) to hold the jaws 70, 71 open during the process of bag engagement described below. When the latch 86 is released, the jaws 70, 71 retract from cable pressure and resultant deflection, and they nest within grooves 77 at the periphery of the frame 30 (i.e., FIGS. 1, 2).

Figure 1:
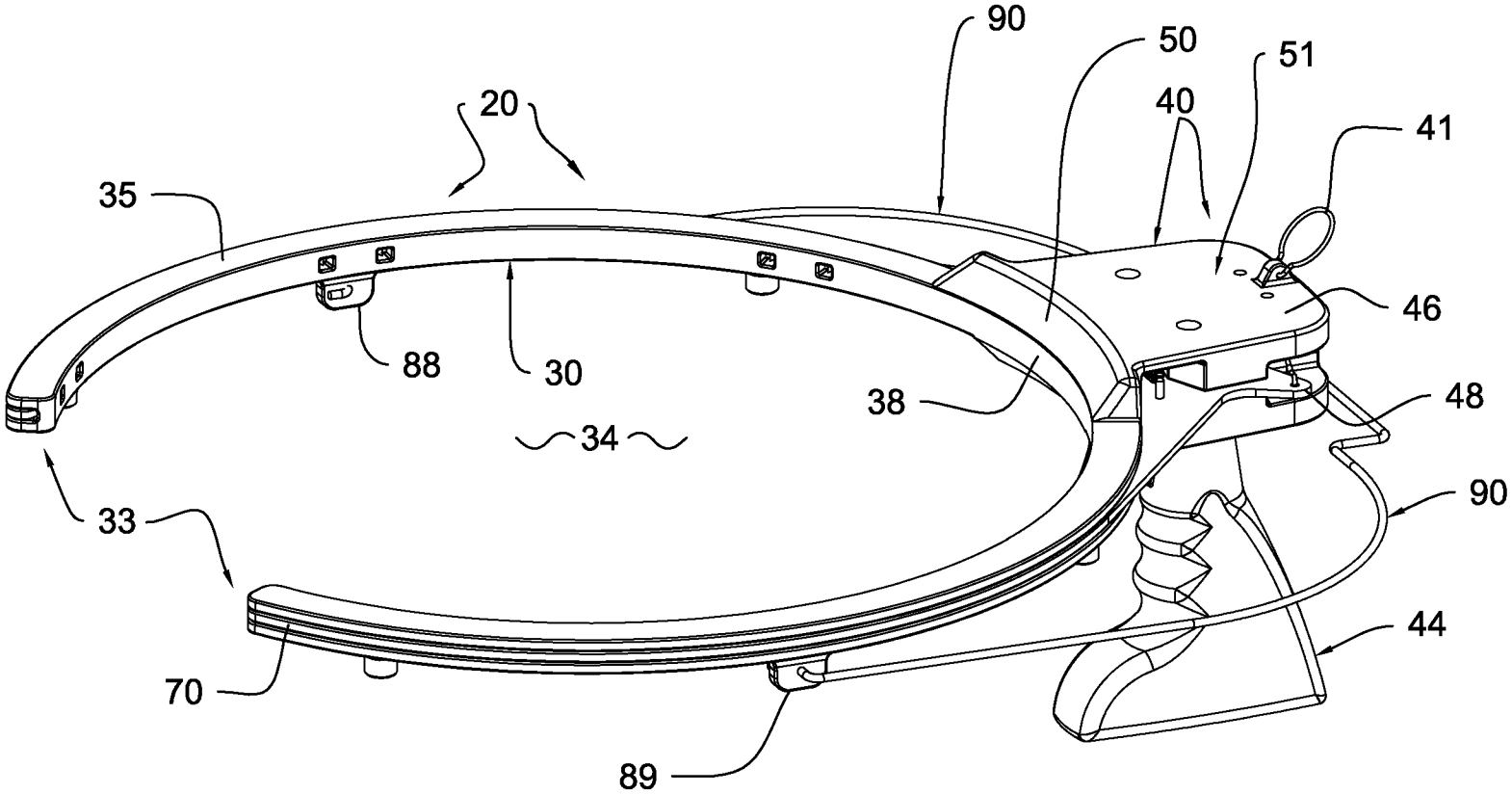
FIG. 1 is a frontal isometric view of my new Hand-held Trash Bag Tool, showing it at rest in an undeployed state.
Figure 2:
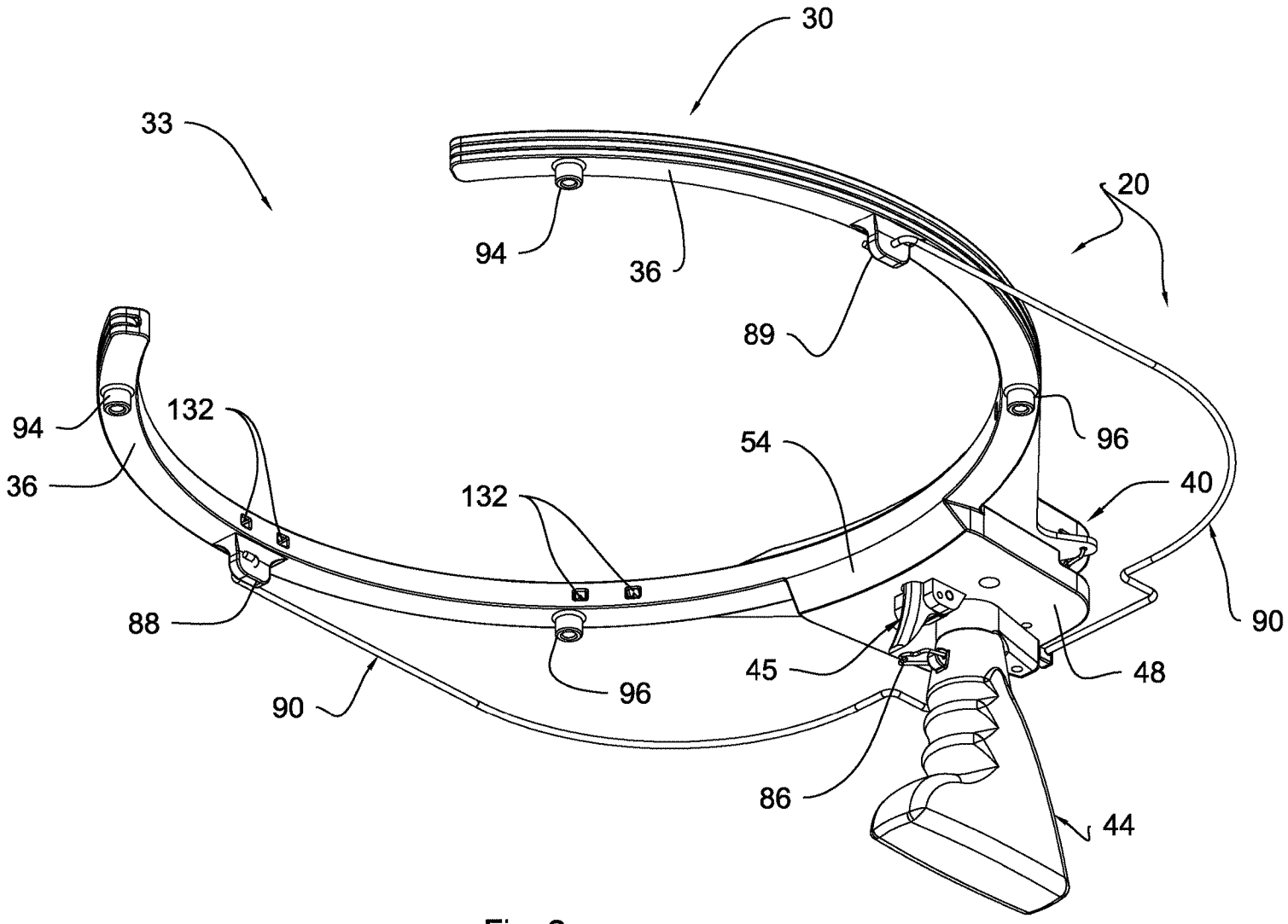
FIG. 2 is a bottom isometric view of my new tool.

Referencing FIGS. 1-4, frame 30 preferably comprises a pair of radially spaced-apart tabs 88, 89 that project downwardly from frame undersurface 36 (FIG. 2). These radially spaced-apart tabs 88, 89 support a displaceable bail 90 that can be moved between a vertical position substantially perpendicular to frame 30 (FIG. 4), and a normal, horizontal storage position (FIG. 1). Bail 90 has feet that are pivotally coupled to tabs 88 and 89, and an integral handle portion 92 that can be grasped by a user of tool 20 for transportation and carrying. The normal retracted or horizontal storage position of the bail 90 is illustrated in FIGS. 1-3, 11, and 12, wherein the bail handle portion is pivoted to a position proximate the handle 44.

Figure 17:
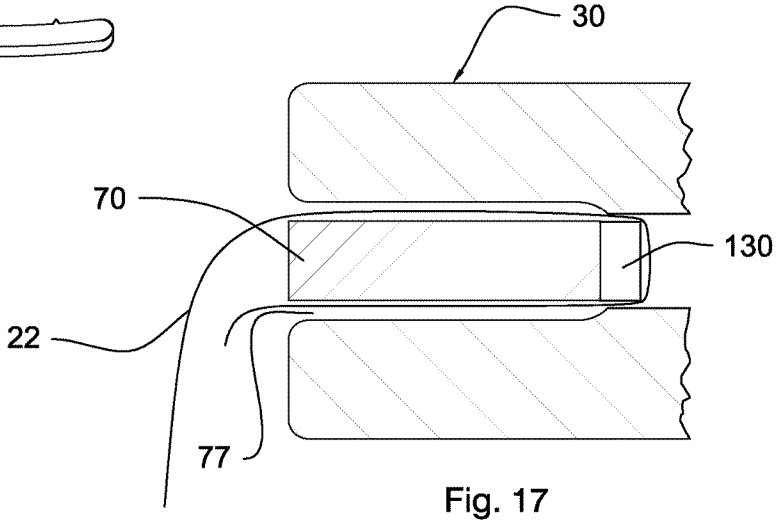
FIG. 17 is an enlarged, fragmentary sectional view taken generally along line 17-17 in FIG. 5.
Figure 18:
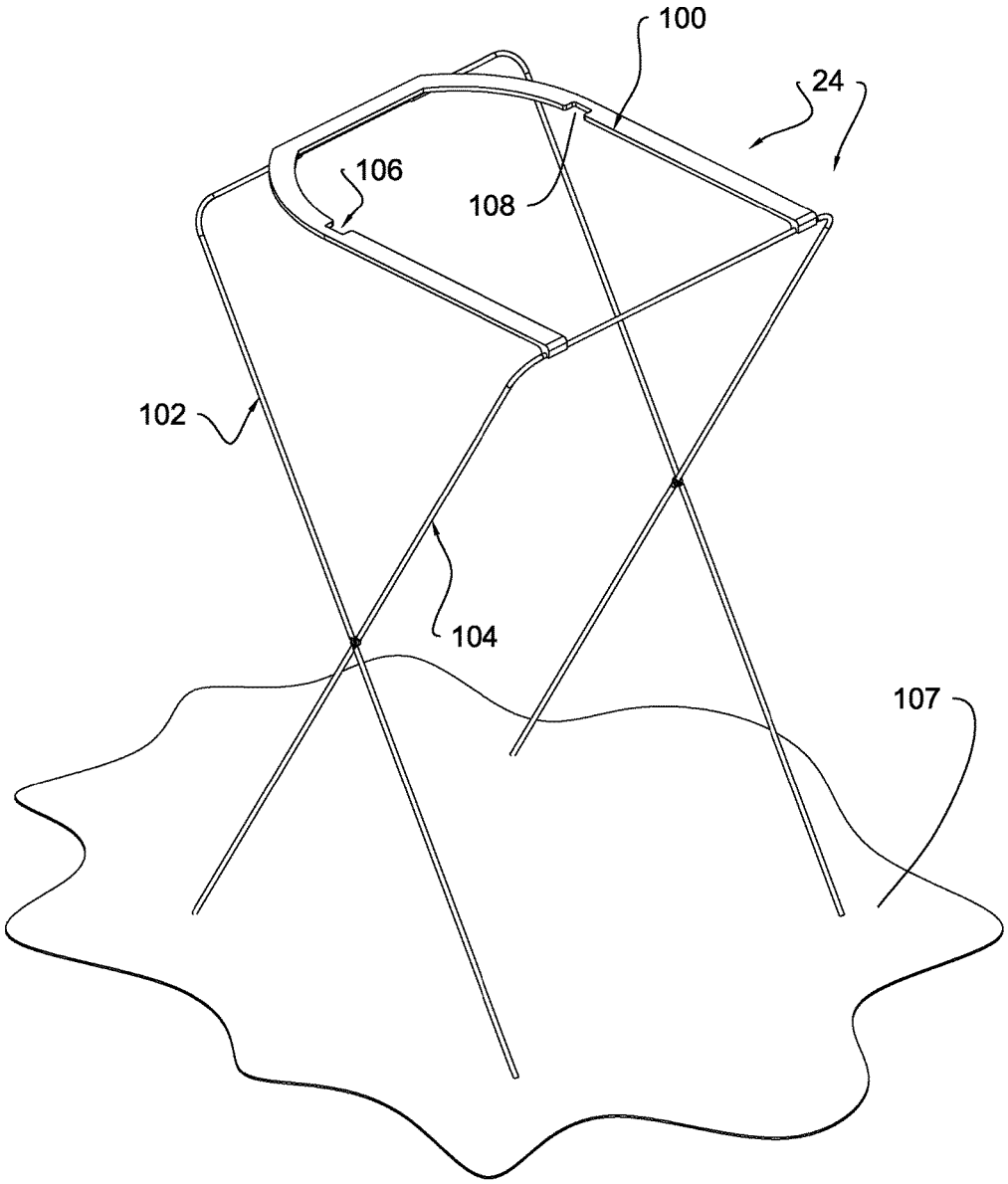
FIG. 18 is a frontal isometric view of an optional rest stand adapted for use with my tool.
Figure 19:
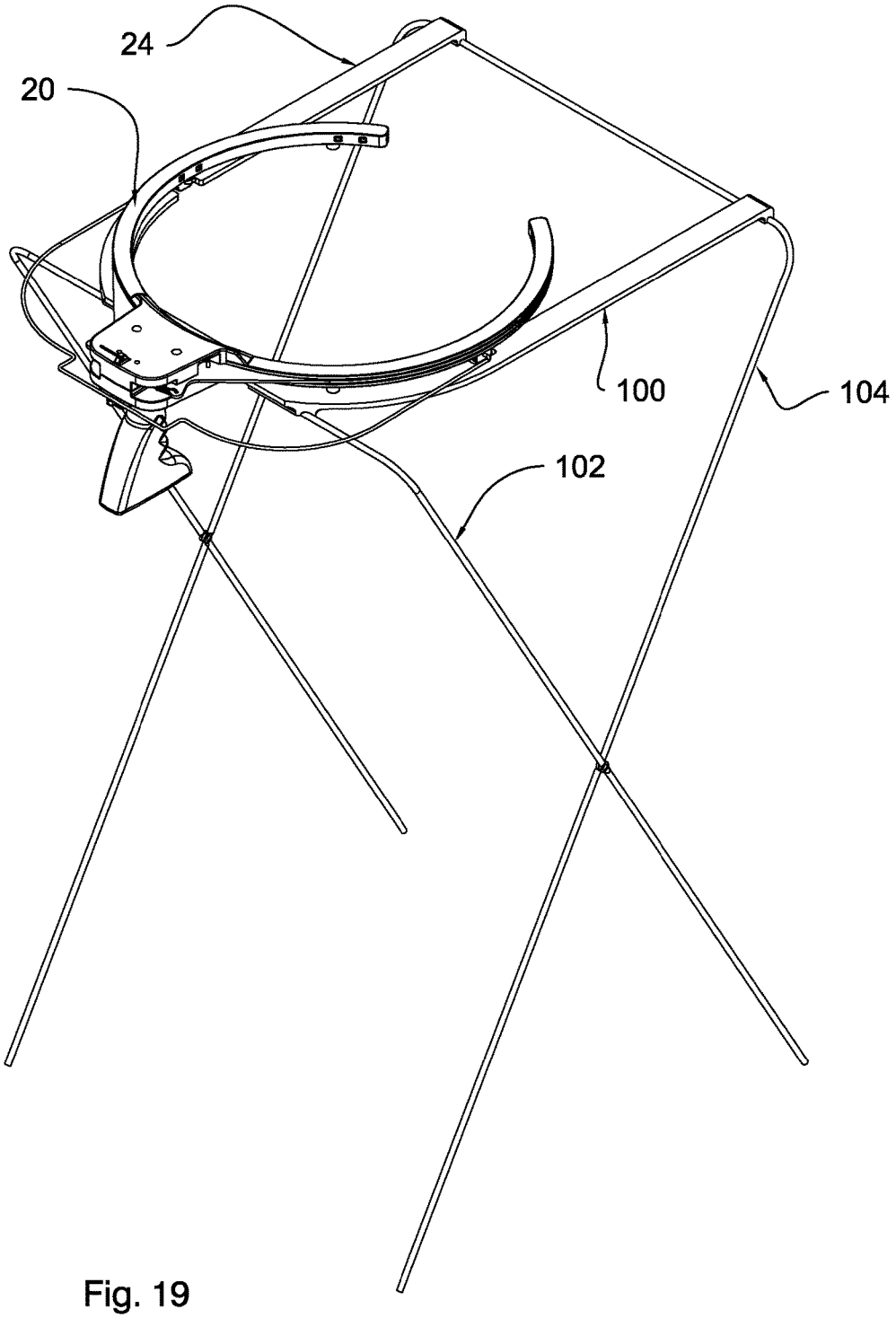
FIG. 19 is a rear isometric view of the optional rest stand with my tool resting upon it.

Preferably, frame 30 also comprises a plurality of radially spaced apart nubs that enable the frame 30 to mate with a suitable receptacle. Thus frame 30 has a pair of radially spaced apart outer nubs 94 (i.e., FIGS. 2-4) and a pair of radially spaced-apart inner nubs 96 that project downwardly from undersurface 36. Noting FIGS. 18 and 19 below, the optional stand 24 comprises a generally C-shaped, horizontal top 100 that is supported by foldably deployable feet 102, 104 that are erected upon and supported by a suitable, horizontal surface 107. There are a pair of radially spaced-apart clearance slots 106 and 108 defined in stand top 100 (FIG. 18). The inner nubs 96 projecting below the tool frame 30 can be received within and registered with slots 106, 108 when the tool 20 is placed upon the stand 24 (FIG. 17). This improves stability and prevents bags captivated by tool 20 from sagging or bending or deforming.

Figure 20:
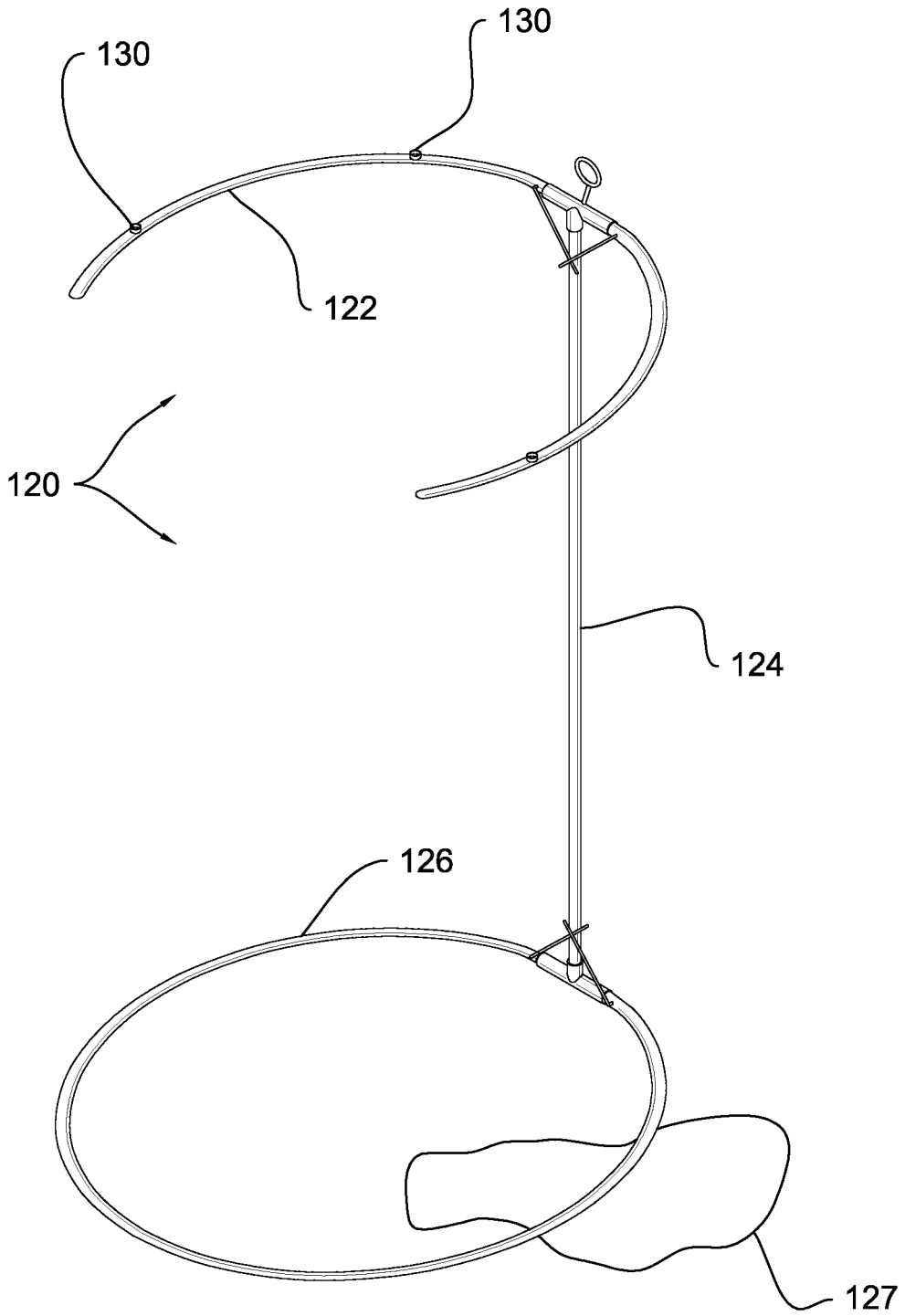
FIG. 20 is a frontal isometric view of an alternative rest stand adapted for use with my tool; and, FIG. 21 is a rear isometric view of the alternative rest stand of FIG. 20.
Figure 21:
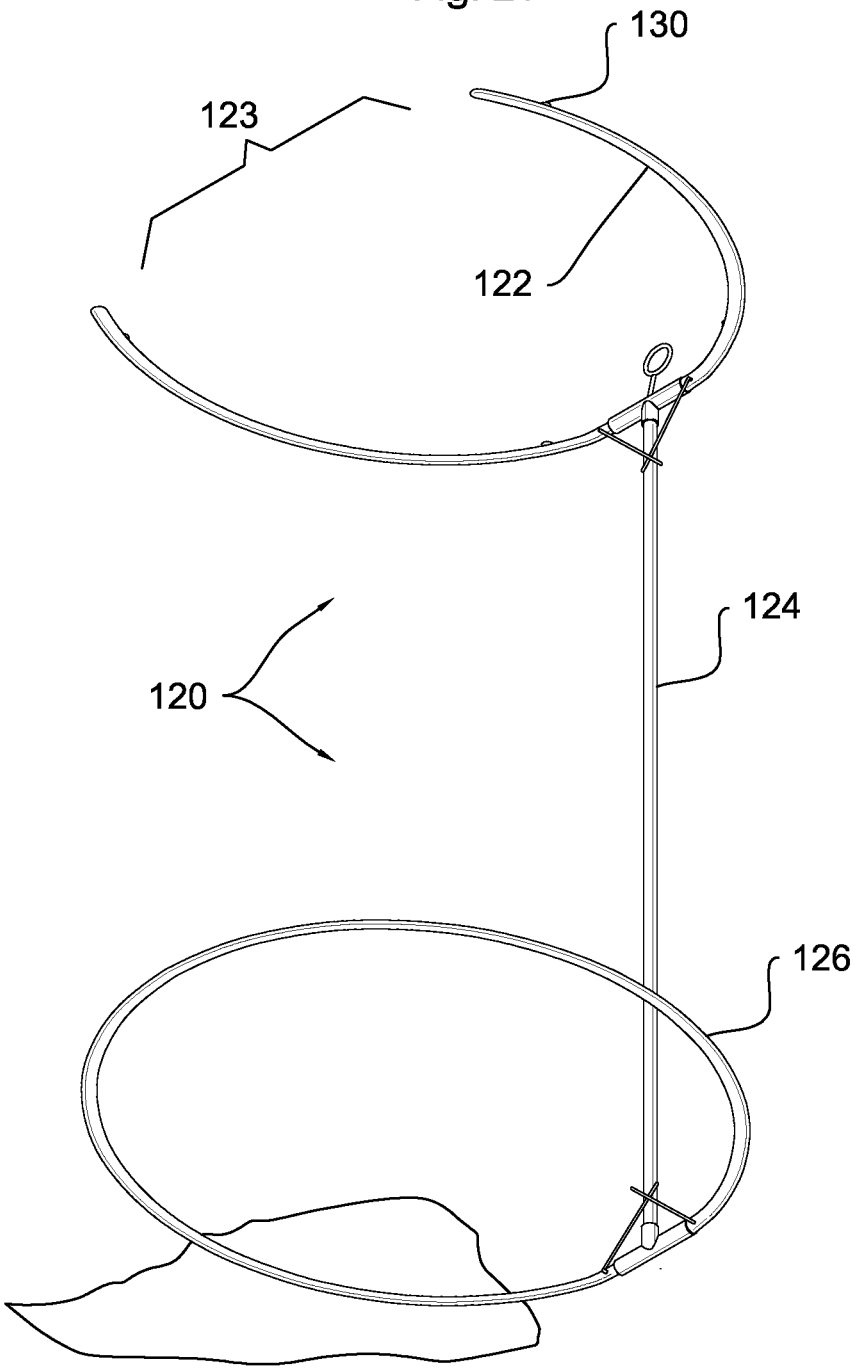

Referencing FIGS. 20 and 21, an alternative stand has been generally designated by the reference numeral 120. There is generally round top 122 with an unobstructed front 123 (FIG. 21). Top 122 is snap-fitted to an upright, vertical pedestal 124 that is snap-fitted at its bottom to a lower, preferably circular ring 126 forming a supporting base for stand 120. Preferably stand 120 is disposed upon a stable, horizontal surface 127, provided, for example, by the ground or a floor. There are a plurality of radially spaced-apart receptors 130 defined in stand top 122 (FIG. 20) that can register with the nubs 96 projecting below the tool frame 30 when the tool 20 is placed upon the stand 120.

To load a garbage bag 22, the trigger 73 may be grasped and depressed by a user with his or her finger, while grasping pistol grip handle 44. With the jaws 70, 71 thus deflected open, the latch 86 (FIG. 3) may be deployed over the trigger 73 to maintain the jaws in an open position, such as that illustrated in FIG. 9.

Viewing FIG. 10, a bag may be moved upwardly as designated generally by arrow 120, while being substantially centered within frame 30. As viewed in FIG. 14, the upper peripheral edge 121 of the bag to be loaded is folded over frame 30, as designated by arrows 122 (FIG. 10) and arrows 123 (FIG. 14), being drawn through space 125 (FIG. 15) between a jaw and the frame 30. At this time a peripheral bag portion 124 will be folded over a jaw 70, 71, and the trigger may be released. The jaws 70, 71 will thereafter refract, and seat within peripheral frame groove 77 (FIGS. 10, 15). Preferably, to make positive contact with bags and to vigorously hold them in captivated position, the jaws 70, 71 are provided with a plurality of rigid, pointed teeth 130 that are aimed towards the tool center. These teeth 130 register within suitable receptive orifices 132 defined in the frame sides within groove 77, so that the teeth seat within these orifices 132, binding the bag and captivating it dependably. The jaws 70, 71 additionally restrain the bag folded over them by being flushly seated within frame groove 77.

From the foregoing, it will be seen that this invention is one well adapted to obtain all the ends and objects herein set forth, together with other advantages which are inherent to the structure.

It will be understood that certain features and subcombinations are of utility and may be employed without reference to other features and sub combinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable, hand-held tool for manipulating, transporting and controlling flexible trash bags, the tool comprising:

a frame for substantially encircling the periphery of said bag(s);

a pair of cooperating, articulated jaws that are displaceable between rest positions proximate said frame and deployed positions spaced from said frame to respectively captivate or release a trash bag;

an activator for selectively displacing the jaws, the activator comprising a handle and a trigger assembly, the activator attached to said frame;

wherein said activator responds to said trigger assembly;

wherein said frame comprises grooves for receiving said jaws when the jaws are retracted; and, a stand for receiving and supporting the tool with a captivated bag disposed in an open position.

2. The combination as defined in claim 1 wherein the frame comprises a plurality of radially spaced apart nubs adapted to mate within clearance slots provided in said stand.

3. The combination as defined in claim 1 wherein the frame is generally circular and has an unobstructed, open end.

4. The combination as defined in claim 3 wherein the frame has a midsection and the activator is compressively attached to said frame midsection.

5. The combination as defined in claim 4 wherein the activator comprises clasp means for compressively engaging the frame midsection.

6. The combination as defined in claim 1 wherein the activator comprises a carrying ring for transporting the tool.

7. The combination as defined in claim 6 wherein the activator comprises a clutch mechanism activated by said trigger assembly while a user grasps said handle.

8. The combination as defined in claim 7 wherein the jaws comprise pivoting hubs with lever means for deflection by said clutch mechanism.

9. The combination as defined in claim 8 wherein the clutch mechanism deflects said jaws with a cable that is activated in response to said trigger assembly and coupled to said lever means.

10. The combination as defined in claim 1 further comprising a displaceable bail can be moved between a vertical position that is substantially perpendicular to said frame for manually grasping said tool, and a horizontal retracted position.

11. The combination as defined in claim 10 wherein the frame comprises at least a pair of tabs, and said bail comprises feet pivotally coupled to said tabs and an integral handle portion that can be grasped by a user for transportation and carrying of said tool when the bail is disposed vertically, the bail handle portion positioned adjacent said activator when the bail is horizontally disposed in said retracted position.

12. The combination as defined in claim 11 wherein:

the frame is generally circular and has an unobstructed, open end;

the frame has a midsection; and, the activator is compressively attached to said frame midsection by clasp means for compressively engaging the frame midsection.

13. The combination as defined in claim 12 wherein the activator comprises a clutch mechanism activated by said trigger assembly while a user grasps said handle.

14. A portable, hand-held tool for manipulating, transporting and controlling flexible, trash bags, the tool comprising:

a hoop-like, generally circular frame for encircling a bag about the periphery of said bag, the frame having a periphery with grooves, the frame having a diameter approximating the diameter of the trash bag, and the frame having an unobstructed, open end;

a pair of cooperating, articulated jaws that are displaceable between rest positions nested within said frame grooves and deployed positions spaced from said frame grooves to respectively captivate or release a trash bag;

an activator attached to said frame for selectively displacing the jaws, the activator comprising a pistol grip handle for manually aiming and handling the tool and a trigger assembly, the activator attached to said frame;

wherein said jaws may be displaced to a position where a peripheral portion of a bag may be disposed between said jaws and said frame; and, a displaceable bail that can be moved between a vertical position that is substantially perpendicular to said frame for manually grasping said tool, and a substantially horizontal retracted position.

15. The tool as defined in claim 14 wherein:

the activator comprises a clutch mechanism activated by said trigger assembly while a user grasps said pistol grip handle;

the jaws comprise hubs pivotally disposed within said activator, the hubs comprising lever means for deflection by said clutch mechanism; and, wherein the clutch mechanism deflects said jaws with a cable that is activated in response to said trigger assembly.

16. The tool as defined in claim 14 wherein the frame comprises at least a pair of tabs, and said bail comprises feet pivotally coupled to said tabs and an integral handle portion that can be grasped by a user for transportation and carrying of said tool when the bail is disposed vertically, the bail handle portion positioned adjacent said activator when the bail is horizontally disposed in said retracted position.

17. The tool as defined in claim 16 wherein the frame comprises a plurality of radially spaced apart nubs adapted to mate within clearance slots provided in a suitable receptacle.

18. The tool as defined in claim 17 wherein:

the activator comprises a clutch mechanism activated by said trigger assembly while a user grasps said pistol grip handle;

the jaws comprise hubs pivotally disposed within said activator, the hubs comprising lever means for deflection by said clutch mechanism; and, wherein the clutch mechanism deflects said jaws with a cable that is activated in response to said trigger assembly.

19. A portable, hand-held tool for manipulating, transporting and controlling flexible trash bags, the tool comprising:

a frame for substantially encircling the periphery of said bag(s);

a pair of cooperating, articulated jaws that are displaceable between rest positions proximate said frame and deployed positions spaced from said frame to respectively captivate or release a trash bag;

an activator for selectively displacing the jaws, the activator comprising a handle and a trigger assembly, the activator attached to said frame;

wherein said activator responds to said trigger assembly;

wherein said frame comprises grooves for receiving said jaws when the jaws are retracted; and, wherein the activator comprises a carrying ring for transporting the tool.

20. A portable, hand-held tool for manipulating, transporting and controlling flexible trash bags, the tool comprising:

a frame for substantially encircling the periphery of said bag(s);

a pair of cooperating, articulated jaws that are displaceable between rest positions proximate said frame and deployed positions spaced from said frame to respectively captivate or release a trash bag;

an activator for selectively displacing the jaws, the activator comprising a handle and a trigger assembly, the activator attached to said frame;

wherein said activator responds to said trigger assembly;

wherein said frame comprises grooves for receiving said jaws when the jaws are retracted; and, a displaceable bail can be moved between a vertical position that is substantially perpendicular to said frame for manually grasping said tool, and a horizontal retracted position.

* * * * *